United States Patent [19]

Laws, Jr.

[11] 4,261,310

[45] Apr. 14, 1981

[54] ASSEMBLY AND METHOD FOR PREVENTING CAM WALK IN AUTOMOTIVE ENGINES

[76] Inventor: Harold W. Laws, Jr., Rte. 2, Box 712A, Maitland, Fla. 32751

[21] Appl. No.: 10,368

[22] Filed: Feb. 8, 1979

[51] Int. Cl.[3] ..... F02B 77/00

[52] U.S. Cl. ..... 123/198 E; 308/163

[58] Field of Search ..... 308/163, 21, 23; 123/90.38, 90.31, 195 C, 195 R, 198 E

[56] References Cited

U.S. PATENT DOCUMENTS

| | | | |
|---|---|---|---|
| 1,520,942 | 12/1924 | Garrett | 123/90.38 |
| 2,474,980 | 7/1949 | Karl | 308/163 X |
| 2,701,845 | 2/1955 | Gallagher et al. | 308/163 X |
| 3,161,447 | 12/1964 | Larsson | 308/163 |

*Primary Examiner*—Harry N. Haroian

*Attorney, Agent, or Firm*—Duckworth, Hobby, Allen, Dyer & Pettis

[57] ABSTRACT

Apparatus for preventing cam walk in an automotive engine of the type including engine block with a cam shaft having one end extending from the block and coupled to the engine's crank shaft by a timing chain includes a timing chain cover fastened to the engine block and covering the cam shaft and the timing chain, with a thrust pin coupled between the cover and extending axial with the cam shaft. A low friction thrust button is adjustable fixed to the thrust pin, so as to permit adjustment of the dimension between the extremity of the cam shaft and the low friction bearing means, thereby reducing "cam walk" during high performance operation of the engine.

The assembly may include a metal spacer interposed between the cover and the block.

12 Claims, 2 Drawing Figures

ASSEMBLY AND METHOD FOR PREVENTING CAM WALK IN AUTOMOTIVE ENGINES

BACKGROUND OF THE INVENTION

1. Field of the Invention

The present invention relates generally to internal combustion engines, and in particular relates to techniques which are designed to prevent undesirable forward movement of the cam shaft, commonly referred to as "cam walk", during high performance operation of an automotive engine.

2. Description of the Prior Art

Stock car racing is a very popular sport in the United States. Participants in this sport constantly seek to improve engine performance and design, and many engine developments which originate in the stock car racing sport eventually are incorporated in assembly line production of automobile engines.

Conventional stock engines, particularly those manufactured by the Chevrolet Division of General Motors Corporation, utilize a timing gear cover which is a stamped piece of sheet metal, which is bolted to the engine block over the extremity of the cam shaft, the timing gear and the timing chain assembly, and includes a hole designed to accept a seal for the front of the crank shaft, with a conventional gasket positioned between the cover and the engine block.

When conventional stock car engines employing conventional covers of the type described above are subjected to high performance, high speed conditions such as are normally incurred during stock car racing events, frequently the extremity of the cam shaft, by virture of the centrifugal force of that shaft, is forced outward and comes in contact with the sheet metal cover. Under sustained high performance conditions, the extremity of the cam shaft often dents the cover, and may destroy the seal between the cover and the engine block. Additionally, the fricion caused by movement of the cam shaft against the cover frequently results in reduced engine efficiency, erratic timing control, worn distributor gears and broken timing chains.

To reduce the serious effects of cam walk, there has been used in the past spacers which are inserted between the extremity of the cam shaft and the conventional sheet metal cover of the type described above. However, these spacers have proved to be unsatisfactory in sustained high performance operation in racing engines.

SUMMARY OF THE INVENTION

The present invention contemplates the use, in a high performance engine of the type including an engine block with a cam shaft having one end extending from the block and coupled to the engine's crank shaft by a timing chain or gears, a replacement cam shaft and timing chain cover assembly for replacing the engine stock sheet metal cover, the replacement assembly comprising an annular, relatively rigid spacer member for surrounding the cam shaft end and the timing chain or gear assembly, with a gasket interposed between the spacer and the engine block. A timing cover having substantially greater tensile strength than the stock cover is fastened to the spacer member and to the engine block. Additionally, a low friction bearing means is interposed between the cover and the end of the cam shaft.

In a preferred embodiment, means are provided for adjusting the dimension between the end of the cam shaft and the low friction bearing means, which means comprises a thrust pin coupled to the cover and extending axially with the cam shaft, the thrust pin being threaded in a left-hand fashion to permit a low friction button forming the low friction bearing means to be threadably fastened to the thrust pin. One or more shims may be inserted between the thrust button and the inside face of the timing cover as is required to obtain the desired adjustment between the extremity of the low friction button and the extremity of the cam shaft.

Preferably, the low friction button comprises a polyresinous material, such as TEFLON.

The present invention further contemplates a method for preventing cam walk in an engine of the type described above, the method including the steps of deburring the one end of the cam shaft, and further comprising the step of deburring the inside face of the timing gear, and thereafter installing the high tensile strength cover and inserting the adjustable thrust button between the one end of the cam shaft and the cover.

THE DRAWING

DETAILED DESCRIPTION

A preferred embodiment of the present invention will now be described with reference to FIGS. 1 and 2.

Figure 1:
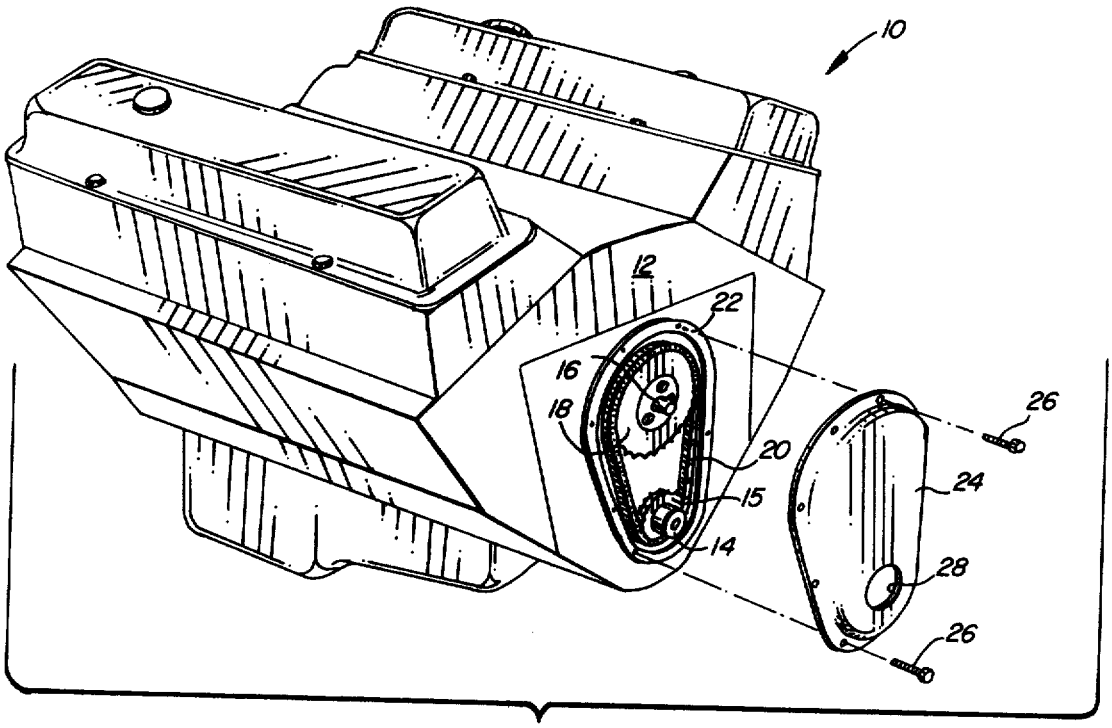
FIG. 1 (PRIOR ART)
FIG. 1 is a prospective view, partially exploded, which illustrates prior art arrangements employing sheet metal covers for the cam shaft extremity and timing chain and gear assembly.

Noting FIG. 1, a conventional engine assembly, referred to by the reference numeral 10, includes an engine block 12. The engine 10 includes a crank shaft having an extremity 14 which extends out of the block and is adapted to be coupled to the engine's balancer for purposes of belt driven coupling to the water pump and engine accessories. A drive gear 15 is coupled to the extremity 14 of the crank shaft. The engine also includes a cam shaft, one extremity 16 of which also extends from the engine block 12, and has a timing gear 18 mounted at that extremity 16 of the cam shaft, the timing gear 18 being coupled to the drive gear 15 of the crank shaft by a timing chain 20.

A conventional stamped metal timing cover 24 is fastened by bolts 26 to the front of the block 12 with a gasket 22 therebetween. The timing cover 24 includes a conventional hole therein for receiving a seal for the crank shaft. It will be understood by those skilled in the art that the balancer is not shown in FIG. 1.

Figure 2:
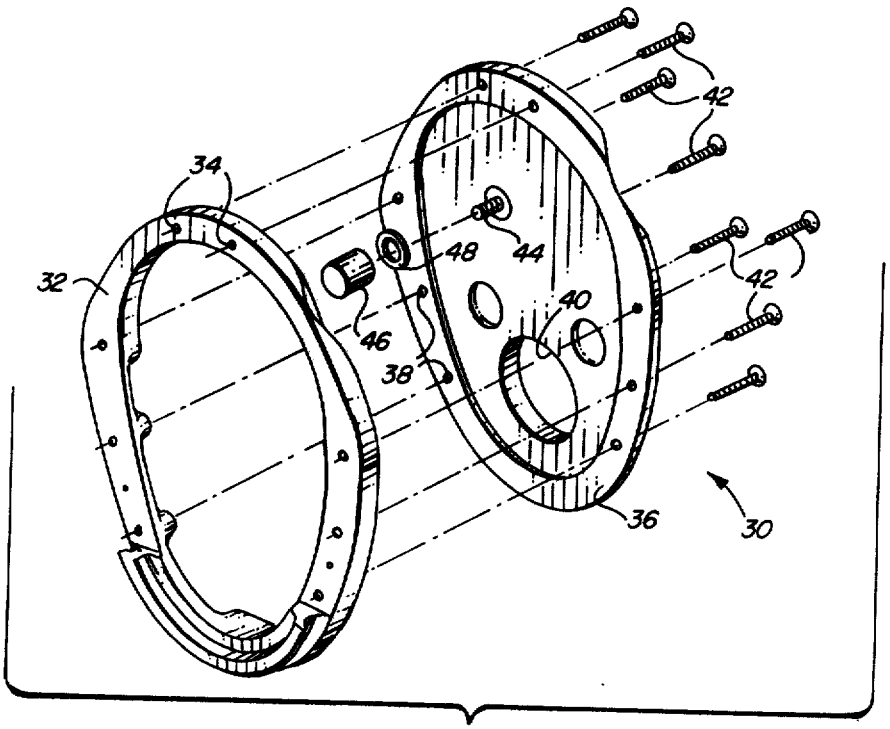
FIG. 2 is an exploded view of the improved timing cover of the detailed invention.

An improved cam cover in accordance with the present invention is shown in FIG. 2 and will now be described with reference thereto.

The improved cover, referred to by the reference numeral 30, includes a spacer 32 having plural holes therein 34 which correspond to the conventional holes in the engine block 12 to permit the spacer to be mounted against the face of the block with the gasket 22 therebetween. Preferably, the spacer 32 comprises casted aluminum.

A cam cover 36 is adapted to be mounted flush with the spacer 32, having corresponding holes 38 permitting fastening of the cover 36 to the spacer 32 with a sealer therebetween. Bolts 42 conventionally fasten the cover 36 and the spacer 32 to the front face of the block 12.

In accordance with the present invention, the cover 36 is fabricated from a casted aluminum or other material having a high tensile strength relative to the tensile strength of the sheet metal cover 24 which is typically included with stock engines in assembly line production.

Further in accordance with the present invention, the cover 36 is provided with a thrust pin 44 extending normal to the cover 36 and axial with the extremity of the cam shaft 16 (note FIG. 1). The thrust pin 44 may be either casted with the cover 36, or bolted thereto. The thrust pin 44 is threaded in a left-hand fashion, in order to receive a correspondingly threaded low friction thrust button 46, which is preferably formed of a poly-resinous material, such as TEFLON. One or more spacers 48 may be inserted between the inside surface of the cover 36 and the thrust button, as is required to adjust the thrust button 46 longitudinally along the thrust pin 44.

In use, the thrust pin is designed to bear against the extremity 16 of the cam shaft, to prevent outward movement of the cam shaft, a phenomenon described above as "cam walk". Prior to use, the thrust button 46 is threaded onto the thrust pin 44 and provided with sufficient shims 48 to permit the thrust button 46 to bear lightly against the extremity 16 of the cam shaft. Because of the high tensile strength of the cover 36 with respect to conventional stock covers, such as the cover 24 shown in FIG. 1, cam walk is prevented.

In order to further facilitate the advantages of the present invention, it has been found that the steps of deburring the forward face of the extremity 16 of the cam shaft, as well as the innerface of the timing gear 18 prior to installation of the thrust button 46 and the cover 36 reduces any damages to the thrust button and prolongs the life of the entire assembly which is designed to prevent cam walk.

I claim:

1. In a high performance engine of the type including an engine block with a cam shaft having one end extending from said block and coupled to the engine's crank shaft by a timing chain, a replacement cam shaft and timing chain cover assembly for replacing said engine's stock sheet metal cover, said replacement assembly comprising:

an annular, relatively rigid spacer member for surrounding said cam shaft end and said timing chain;

a gasket interposed between said spacer member and said engine block;

a timing cover having substantially greater tensile strength than said stock cover;

means for fastening said cam and timing cover with said spacer member and to said engine block;

a thrust pin coupled to said cover and extending axial with same cam shaft; and a low friction button adjustably fastened to said thrust pin, to adjust the dimension between said one end of said cam shaft and said thrust pin.

2. The assembly recited in claim 1 wherein said cam and timing cover includes a hole therein for receiving the extremity of said crank shaft.

3. The assembly recited in claim 1 further comprising at least one shim about said pin and between said cover and said thrust button.

4. The assembly recited in claim 3 wherein said low friction button comprises a poly-resinous material.

5. The assembly recited in claim 4 wherein said pin has a left-hand thread.

6. Apparatus for preventing cam walk in an engine of the type including an engine block with a cam shaft having one end extending from said block and coupled to the engine's crank shaft by a timing means, said apparatus comprising:

a cam shaft and timing cover fastened to said engine block and covering said cam shaft end and said timing chain;

a thrust pin coupled to said cover and extending axial with said cam shaft; and a low friction thrust button threaded onto said thrust pin, for adjusting the dimension between said one end of said cam shaft and said low friction button.

7. The apparatus recited in claim 6 further comprising a metal spacer between the periphery of said cam shaft and timing cover and said engine block.

8. The apparatus recited in claim 6 further comprising at least one shim about said pin and between said cover and said thrust button.

9. The apparatus recited in claim 6 wherein said thrust button is formed of a poly-resinous material.

10. The apparatus recited in claim 6 wherein said cam shaft and timing cover includes a hole therein for receiving the extremity of said crank shaft.

11. A method for preventing cam walk in an engine of the type including an engine block with a cam shaft having one end extending from said block with a timing gear fitted on said one end, said timing gear coupled to the engine's crank shaft with a timing means, said method comprising the steps of:

deburring said one end of said cam shaft;

installing a relatively high tensile strength cover over said cam shaft end, and said timing gear and chain assembly;

fixing a thrust pin to the inside of said cover and extending toward said one end of said cam shaft;

threading an adjustable thrust button onto the extremity of said thrust pin between said one end of said cam shaft and said cover; and adjusting said thrust button so as to bear against said one end of said cam shaft.

12. The method recited in claim 11 further comprising the step of deburring the side of said timing gear facing said engine block.

* * * * *